US005459538A

United States Patent [19]

Petry, Jr. et al.

[11] Patent Number: 5,459,538

[45] Date of Patent: Oct. 17, 1995

[54] PHOTO MOUNTING EQUIPMENT

[75] Inventors: Chester H. Petry, Jr., Tigard; Edwin J. Fackler, Portland, both of Oreg.

[73] Assignee: Byers Industries, Inc., Portland, Oreg.

[21] Appl. No.: 45,051

[22] Filed: Apr. 7, 1993

[51] Int. Cl.[6] ..... B65B 63/00

[52] U.S. Cl. ..... 353/103; 353/DIG. 1; 53/520; 53/284.2

[58] Field of Search ..... 353/103, 108, 353/118, 121, 122, DIG. 1; 53/520, 284.2

[56] References Cited

U.S. PATENT DOCUMENTS

| | | | |
|---|---|---|---|
| 1,554,429 | 9/1925 | Hasselquist | 271/106 |
| 2,725,155 | 11/1955 | Fitch et al. . | |
| 2,893,146 | 7/1959 | Geiger | 353/DIG. 1 |
| 3,045,867 | 7/1962 | Flynn | 353/103 |
| 3,067,805 | 12/1962 | Flynn . | |
| 3,470,642 | 10/1969 | Mundt et al. . | |
| 3,562,074 | 2/1971 | Mundt et al. . | |
| 4,256,527 | 3/1991 | Green | 156/442 |
| 4,543,771 | 10/1985 | Jensen et al. | 53/284.2 |
| 4,748,799 | 6/1988 | True et al. | 53/284.2 |
| 4,934,124 | 6/1990 | Savio et al. | 53/411 |
| 4,934,128 | 6/1990 | Savio et al. | 53/520 |
| 5,168,688 | 12/1992 | Neuhold | 53/284.2 |
| 5,263,301 | 11/1993 | Gerrans | 53/284.2 |

OTHER PUBLICATIONS

Byers Photo Equipment Co., Automounter V, Model No. 110–027 Specification Sheet.

*Primary Examiner*—William A. Cuchlinski, Jr.
*Assistant Examiner*—William C. Dowling
*Attorney, Agent, or Firm*—Marger, Johnson, McCollom & Stolowitz

[57] ABSTRACT

The system comprises a hopper attached below a table for holding two stacks of the slide mounts. A pick-off station removes the slide mounts from the slide mount stack. The slide mount is moved to a slide mounting station and then sealed underneath a ultrasonic welding head. The hopper includes a carousel that rotates either stack into a predetermined position underneath the pick-off station. The motorized hopper used in conjunction with the pick-off mechanism and hold-down apparatus eliminate the previous problems associated with slide mount jamming. The ultrasonic welding head vibrates the top half of the slide mount creating a friction between the internal faces of the top and bottom halves of the slide mount. This friction heats adhesive inside the slide mount sealing the top and bottom halves of the slide mount together. The ultrasonic welding head allows slide mounts to be sealed without using a high temperature heat source keeping photographic slides from being destroyed in the event that the slide mount becomes jammed during the sealing process.

20 Claims, 12 Drawing Sheets

PHOTO MOUNTING EQUIPMENT

BACKGROUND OF THE INVENTION

This invention relates generally to slide mounting equipment and more particularly to a novel method and apparatus for loading and sealing photographic film into mounts. Previous automatic slide mounters, such as the Automounter V®, Model No. 110-027, manufactured by Byers Photo Equipment Co., Portland, Oreg. 97223-0061, have a slide mount hopper that extends above a slide mounter table holding a supply of new slide mounts. By means of an electropneumatic process the slide mounts are forced, one at a time, out from under the stack in the hopper. In the process the mount is folded into a 90° configuration then moved further into a position to accept a single photograph frame from a film reel or roll.

A second device advances the film over the slide mount and cuts the film while a paddle holds the frame in the proper position in the slide mount. Another electropneumatic system advances the film and slide mount back through a set of compression rollers that complete the slide mount closing procedure and also act as a feed mechanism to advance the now closed slide mount into a five-position heat track. The heat track, or heat tunnel, is set at around 325° and is electrically heated. The slide mount is advanced through the heat tunnel and, at the same time, compressed so that a heat-sensitive adhesive coated on the inside of the cardboard slide mount seals the two sides of the slide mount together. The mount is moved along the heat track with a ratchet type mechanism that both compresses the mount and allows for the heat from both sides of the track to penetrate the cardboard and activate the adhesive. The mount is then advanced out of the heat track and allowed to sit and cool in a small hopper.

The present system has to get enough heat on the slide mount to properly seal the film inside the slide mount without also damaging the film. For example, any delay in the movement through the heat track can destroy the film. This requires a slide mount operator to continuously monitor the mounting process. If one of the slide mounts becomes jammed along the heat track, the film inside the slide mount is generally destroyed unless the operator quickly detects the problem. The slide mount operator can also be burned while attempting to remove the jammed slide mount from the heat track unless care is taken. Because any jam in the machine requires immediate action, an operator can not perform other tasks while the slide mounter is in operation. Thus, the machine must be shut-off or a second operator used when the first operator is diverted way from the mounting equipment.

Because cardboard slide mounts are soft and have a tendency to absorb moisture, the thickness of each slide mount can change. Therefore, the present method of feeding slide mounts from a stack, allow the relatively soft slide mounts to catch or jam in the slide mount hopper. When the hopper becomes jammed, an operator must manually shut-off the slide mount equipment and dislodge the jammed slide mount. In addition, any moisture in the slide mounts or any surface adhesion between adjacent slide mounts while residing in the slide mount hopper can cause two or more slide mounts to stick together. The sticking together of multiple slide mounts also cause jamming or misfeeds in the slide mounter. Metering gates have been used to control the moving of slide mounts into the mounting apparatus, however, problems with jamming and misfeeds still exist.

Accordingly, a need remains for an automated slide mounter that seals slide mounts without the possibility of destroying the inclosed film and that is less likely to misfeed or jam.

SUMMARY OF THE INVENTION

It is, therefore, an object of the invention to reduce slide mount jamming and misfeeds in photographic slide mounting apparatus.

Another object of the invention is to reduce the time required to reload slide mounts into slide mounting equipment.

A further object of the invention is to reduce the risk of destroying photographic slides while being mounted into slide mounts.

The invention is a system for mounting film into slide mounts. The system comprises a table that has a feed for moving a film strip through a film feed channel. The film is moved into a slide mounting station where slide mounting equipment inserts and seals individual photographic slides from the film strip inside slide mounts. A hopper is attached below the table and holds two stacks of the slid mounts. A pick-off station is located above one of the slide mount stacks and removes the slide mounts from the top of the slide mount stack one at a time. The slide mounts are then moved to a slide mounting station. The hopper has a motorized lift that moves the stack of slide mounts upward each time the top slide mount is removed from the stack.

The hopper includes a carousel for holding the two stacks of slide mounts. The carousel rotates either stack into a predetermined position underneath pick-off apparatus. After a slide mount is removed from one of the stacks with the pick-off apparatus, it is placed in an in-feed station and bent into an initial holding position for receiving a photographic slide. The slide mounting equipment includes a knife and paddle. The knife slices the reel of film into individual photographic frames and the paddle holds the film in the slide mounts in a first step of the mounting process. A carriage then moves the slide mount and film underneath compression rollers that further fold the slide mount around the inserted film. The carriage then moves the folded slide mount underneath an ultrasonic welding head that seals the film inside the slide mount.

The hopper keeps the top of the stack at a constant level by moving the stack upwards each time a slide mount is removed from the slide mount stack. Each stack of slide mounts is held in an individual rack that retains and keeps the stack of slide mounts aligned in substantially the same direction. The stack of slide mounts is continually and automatically advanced up to the proper level by use of a stepper motor and a threaded rod so that the mounts are always in the exact position when the pickup apparatus picks up a mount. Two stacks of slide mounts sitting on a rotatable carousel allow an operator to run the machine from one hopper while putting a fresh stack of slide mounts in the second hopper. The dual hopper arrangement also allows the operator in a small amount of time to move from an empty hopper to a full hopper. A hold-down apparatus resides on top of one stack of slide mounts and is electro-mechanically coupled to the stepper motor to indicate when a slide mount has been removed from the stack and to prevent more than one slide mount from being lifted off the stack at the same time. The hold-down apparatus includes a hold-down arm that pivotally holds down the top slide mount on one side as the pick-off mechanism lifts up on the opposite side. This novel hold-down/pick-off system reduces the possibility of more than one slide mount being removed from the stack at the same time. In addition, by taking the slide mounts from the top of the stack as opposed to sliding the mounts from under a stack, the chance of slide mounts jamming and misfeeds is greatly reduced.

The pick-off mechanism includes first and second pneumatic vacuum plates that have separately controlled vacuum elements for lifting and positioning the slide mounts. The first vacuum plate picks the slide mount off the top of the stack into a in-feed station where a platform bends the slide mount into a 90 degree position. The second vacuum plate then moves the bent slide mount into a slide mounting station where a single photographic frame from the film strip is cut and placed into the slide mount. The slide mount is then folded by the compression rollers and the film sealed into the slide mount with the ultrasonic welding head.

The motorized hopper used in conjunction with the pick-off mechanism and the hold-down apparatus eliminate the previous problems associated with slide mount jamming. The electro-mechanical communication between the hold-down arm and the hopper lift arm also increase the precision and controllability of the slide mounts in the mounting system. This further reduces the number of slide mounts that become misaligned or misfed in the slide mount system. In addition, the dual hopper carousel reduce the amount of time previously required to reload the slide mounting equipment.

The ultrasonic welding head vibrates the top half of the slide mount creating a friction between the internal faces of the top and bottom halves of the slide mount. This friction heats the adhesive previously inserted inside the slide mount melting the heat sensitive adhesive and sealing the top and bottom halves of the slide mount together. The ultrasonic welding head allows slide mounts to be sealed without using a high temperature heat source. This vibration technique eliminates the possibility that photographic slides will be destroyed in the event that the slide mount becomes jammed during the sealing process.

The foregoing and other objects, features and advantages of the invention will become more readily apparent from the following detailed description of a preferred embodiment of the invention which proceeds with reference to the accompanying drawings.

DETAILED DESCRIPTION

Figure 1A:
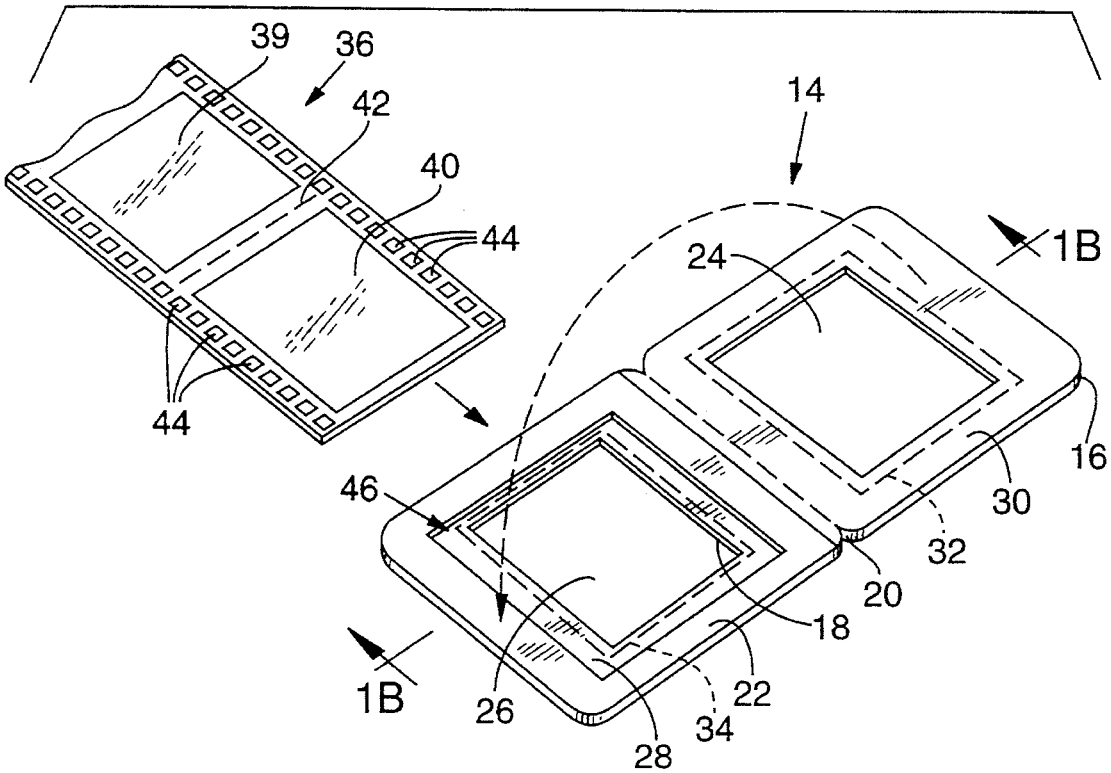
FIG. 1A is a perspective of a slide mount in an open position according to the invention.

FIG. 1A is a perspective of a slide mount 14 in an open position. The slide mount 14 comprises a top frame 16 coupled at first end 20 to a bottom frame 18. The top frame 16 and bottom frame 18 each have windows 24 and 26, respectively of approximately the same dimensions. A spacer 22 i.e., film pocket is coupled to the inside face 28 of the bottom frame 18 and creates an internal cavity 46 extending up from the inside face 28 of frame 18. An inside face 30 of frame 16 is molded around window 24 creating an elevated area 32. The inside face 28 is also molded to provide an elevated area 34. Multiple individual film frames 39 and 40 are attached end-to-end to create a film strip 36. Each individual frame is spaced apart longitudinally on the film by a section 42 and contains notched tracks 44 on the opposite lateral sides of the film strip 36.

A film strip 36 is sliced at section 42 creating a single film frame 40 that fits inside cavity 46 of slide mount 14. After inserting the film into cavity 46 the top frame 16 of slide mount 14 is folded over approximately 180° so that the inside face 30 of frame 16 presses against spacer 22. An adhesive is applied to spacer 22 that becomes tacky when exposed to a given level of heat. Thus, by heating the spacer 22 and pressing the front and back frames of the slide mount together, the inside face 30 of top frame 16 adheres to the spacer 22. Slide 40 is thereby sealed into cavity 46 between the front and back frames of the slide mount.

Figure 1B:
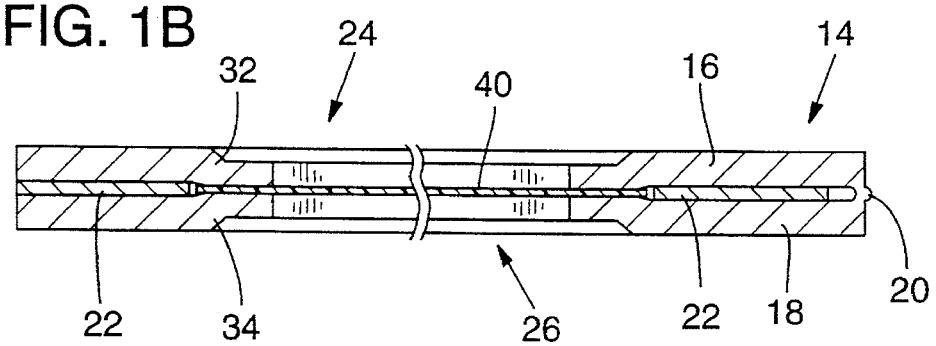
FIG. 1B is a cross-sectional side view of the slide mount shown in FIG. 1A in a closed position.

To illustrate further, FIG. 1B is a cross-sectional side view of the slide mount 14 shown in FIG. 1A in a closed position. In the closed position the top frame 16 and bottom frame 18 press against opposite sides of spacer 22. The slide mount folds together about first end 20 that pivotally couples the front and back frames together. The slide 40 is pressed between the elevated sections 32 and 34 limiting the movement of the slide. The windows 24 and 26 are dimensioned to reside over the photographic image on slide 40. Thus, a light source, for example, from a slide projector, can pass into window 26, though slide 40, and out of window 24. The spacer 22, in addition to adhering the front and back frames together, limits the movement of slide 40 inside the slide mount. The limited movement of slide 40 keeps the image aligned with the frame windows 24 and 26. The limited movement of slide 40 prevents the slide from becoming skewed in slide mount 14. Thus, the slide 40 maintains a constant perpendicular orientation with respect to a light source directed perpendicular through the windows of the slide mount 14.

Figure 2:
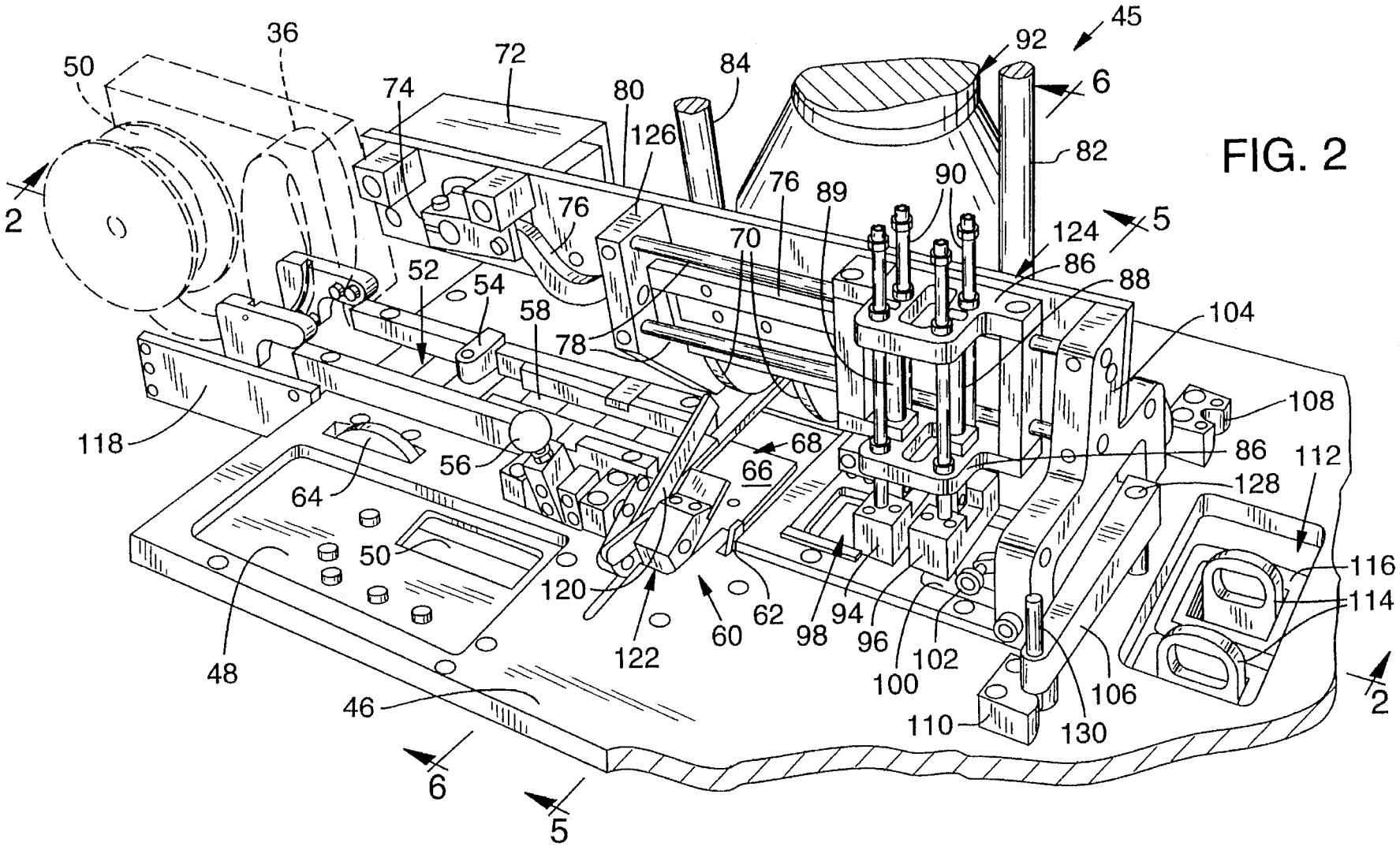
FIG. 2 is a perspective view of a slide mounter according to the invention.

FIG. 2 is a perspective view of a slide mounter 45 according to the invention. The slide mounter 45 is used to slice the film strip 36, insert the film frame 40 into slide mount 14, fold the slide mount 14 over the strip 40, and seal the front and back frames of the slide mount together as previously shown in FIGS. 1A and 1B.

A table 46 holds all of the slide mount apparatus. A film reel 50 is coupled to the top of table 46 by support arms 118. The film strip 36 from reel 50 is run along film feed channel 52 into a film mounting station 60. A splice sensor 54 is coupled to the side walls of the film feed channel 52. A manual film feed control wheel 64 extends out of table 46 and controls teeth 162 inside channel 52. A computer control system 48 extends out of the tip of 46 and contains various control knobs and a display panel 50 for controlling the various electro-mechanical devices in the slide mounter 45. The film mounting station 60 comprises a knife 120, film hold down paddle 122, and a carriage 66.

A mounting plate 80 is held horizontally above table 46 by a support plate 104. A pair of horizontally aligned slide rods 78 are coupled between a support arm 126 and support plate 104. Compression rollers 70 are coupled to the actuator plate 80 and hang over a track 68. A pick-off assembly 124 rides along the slide rods 78 and is coupled to a motor 72 by a pull bar 76. The pull bar 76 is connected at a first end to the motor 72 and is supported in the middle by support arm 126. The pick-off assembly 124 moves over slide mount stack 100, slide mount staging area 98 and film mounting station 60. The pick-off assembly 124 comprises a set of mounting plates 86 that support a set of vacuum hoses 90 and pneumatically actuated support pistons 88 and 89. The end of support piston 88 is coupled to a vacuum plate 96 and the end of support piston 89 is coupled to the top of vacuum plate 94.

A slide mount hopper (not shown) is attached underneath table 46 and holds a stack of slide mounts 100 underneath a hold-down mechanism 102 pivotally coupled to a rod (not shown) residing between the legs of support plate 104. A handle 106 is pivotally coupled by a post 128 to a carousel (not shown) inside the slide mount hopper. The pick-off mechanism is further described in FIGS. 3 and 8 and the slide mount hopper is further described in FIGS. 3 and 7. The handle 106 rotates about post 128 and has a post 130 at the opposite end that resets in either of two stops 108 and 110. A second stack of slide mounts 116 resides in the slide mount hopper and is accessible from the top of the table 46 through a hole 112. Both slide mount stacks 100 and 116 are held in the hopper by a rack 114. An ultrasonic welding head 92 is supported by vertically aligned posts 82 and 84 and is described in detail below in FIGS. 5 and 6.

The slide mounter 45 operates in the following manner. The end of film strip 36 is manually moved through film feed channel 52 by rotating wheel 64. The end of film strip 36 is aligned in an initial run position underneath knife 120. The operator uses alignment pins inside the film feed channel (not shown) to identify the proper location for slicing the film strip (i.e., section 42 in FIG. 1A). The film strip 36 can be sliced manually by pressing forward on lever 56, for example, to remove spliced sections of the film strip 36.

The hopper (FIG. 7) is then loaded with slide mounts and slide mount stack 100 is lifted vertically upward into a run position. The operator presses a run button on control panel 48 and the slide mounter 45 begins normal mounting operations. During the mounting operation vacuum plate 96 from pick-off assembly 124 lifts the top slide mount from stack 100 and moves the slide mount to an in-feed station 98. In the in-feed station 98, while vacuum plate 96 still is attached to the slide mount, a lever (see FIG. 5) bend the slide mount into a 90° position as will be further described below. The pick-off assembly 124 is then moved back by pull bar 76 into the original pick-off position so that vacuum plate 96 resides over slide mount stack 100. Vacuum plate 94 then moves the bent slide mount residing within in-feed station 98 into slide mount station 60. A section of the film strip 36 (i.e., slide) is then sliced by knife 120 and held down into the cavity 46 (see FIG. 1A) of the slide mount. The slide mount and slide are then transported by carriage 66 underneath compression rollers 70 that folds the top frame of the slide mount over the slide against the back frame. A set of carriage pusher bars 62 then move the slide and slide mount underneath welding assembly 92.

The welding assembly (see FIGS. 10 and 11) is then moved vertically downward pressing all slides of the frame further together and vibrating the top of the slide mount at an ultrasonic frequency. The frictional heat created by vibrating the top and bottom frames cause the adhesive on spacer 22 (FIG. 1A) to melt, gluing the top and bottom frames together. The carriage pusher bar then moves the slide mount from under the welding assembly into a printer (not shown) that prints alpha-numeric information characters on the outside of the slide mount. The slides are then placed into a transport channel (not shown) and placed into a receiving bin.

Figure 3:
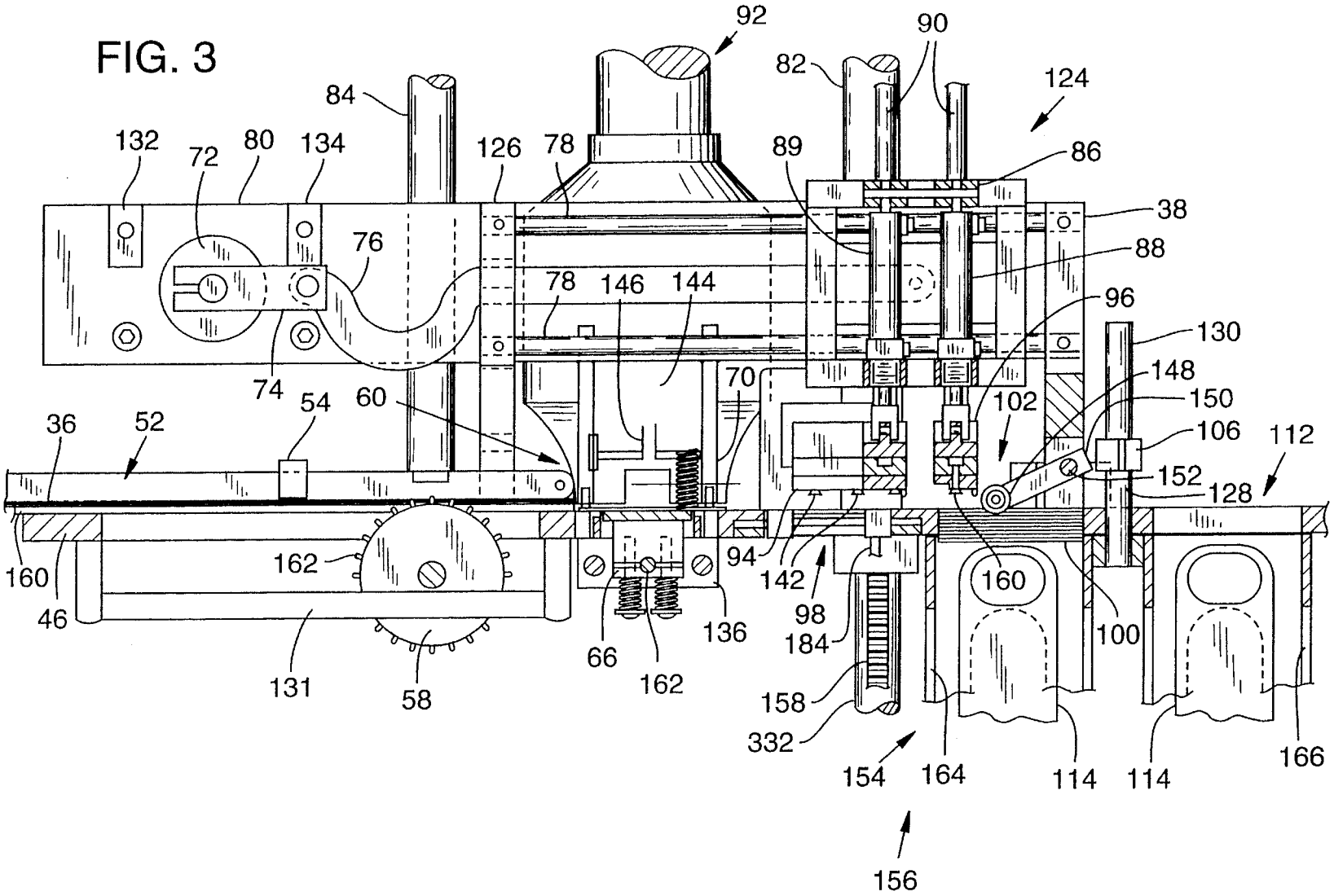
FIG. 3 is a cross-sectional front view of the slide mounter shown in FIG. 2.

FIG. 3 is a cross-sectional front view of the slide mounter shown in FIG. 2. Underneath table 46 is a fluorescent light 131 that illuminates a translucent floor 160 of film feed channel 52. A film drive sprocket 58 has teeth 162 that extend slightly out into the film feed channel 52 and fit into the lateral notches 44 in film strip 36 (FIG. 1A). The splice sensor 54 resides slightly over the translucent floor 160. The motor clamp 74 is restricted to a 180 degree rotation by actuator stops 132 and 134. The film mounting carriage 66 is carried on a set of slide bars 161 between the film mounting station 60 and the compression rollers 70 and is stopped by a stop plate 136. A hold-down assembly 146 is pivotally coupled to the back of the compression rollers 70 and is held up at the top end by a spring 144. A section of the slide mount hopper 154 includes a vertically aligned screw rod 158 and a carousel 156 that includes a first magazine 164 shown partially loaded with a stack of slide mounts 100 and a second magazine 166. The post 128 extends through table 46 and is coupled to carousel 156. The hold-down mechanism 102 includes a hold-down arm 150 coupled at a top end to a rod 152 and attached at the bottom end to a wheel 148. The rod 152 extends through the two legs of support plate 38. A set of vacuum cups 160 extend from the bottom of the vacuum plate 96 and a set of vacuum cups 142 extend downward from the bottom of vacuum plate 94.

The light 131 displays the film strip 36 to the slide mount operator when initially aligning the film strip in the film feed channel 52. Alternatively, when there is a splice in the film strip 36, splice detection sensor 54 acknowledges the splice stopping the film mounting operation. The operator then realigns the film strip 36 by rotating wheel 64 (FIG. 2) synchronously moving sprocket 58. The vacuum cups 160 are lowered down on top of the top slide mount in slide mount stack 100 by pneumatically lowering vacuum plate 96. After plate 96 is lowered, vacuum cups 160 are activated adhering to the top slide mount. Vacuum plate 96 is pneumatically raised lifting up the top slide mount. Motor 72 then rotates clamp 74 clockwise pulling slide bar 76 and moving vacuum plate 96 over in-feed station 98. Vacuum plate 96 is then lowered and a lifter pushes the top frame of the slide mount upwards 90° using vacuum plate 96 as an anchor holding the bottom half of the slide mount in the floor of in-feed station 98. The vacuum cups 160 are deactivated and vacuum plate 96 raised leaving the slide mount in in-feed station 98. Motor 72 is then reversed to a counter-clockwise rotation moving pull bar 76 forward until clamp 74 contacts stop 134. Pick-off assembly 124 is moved back into its original position.

Vacuum plate 94 is then lowered pressing vacuum cups 142 against the bottom frame of the slide mount. The vacuum cups 142 are then activated and the vacuum plate 94 raised lifting the slide mount. Motor 72 is then directed back into a clockwise rotation moving the slide mount into the slide mounting station 60. The vacuum cups 142 are then deactivated and vacuum plate 94 raised leaving the slide mount on carriage 66. The pick-off assembly 124 is then moved back over slide mount stack 100.

Figure 8:
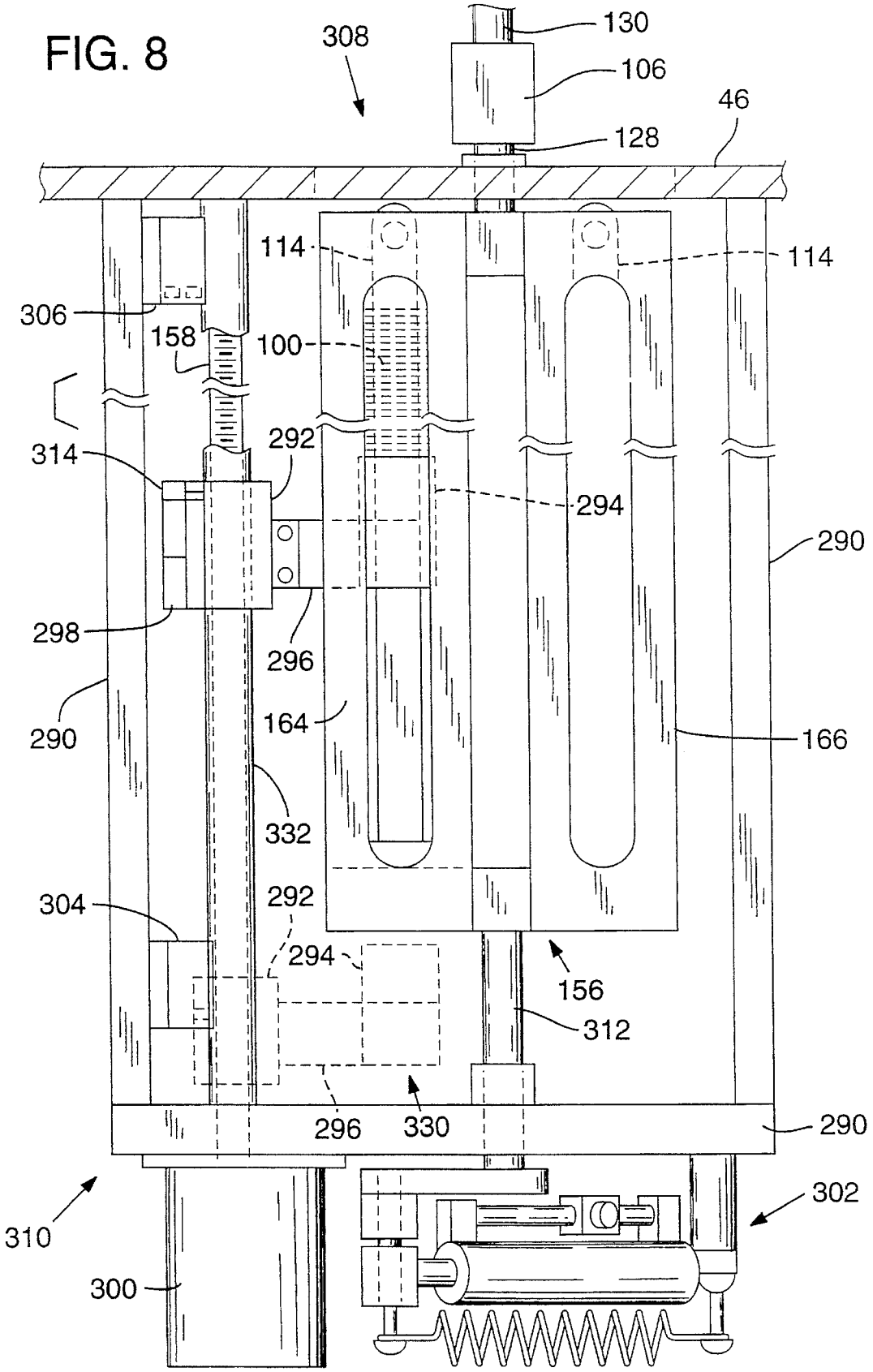
FIG. 8 is a front view of a slide mount hopper.

The hold-down assembly 102 prevents multiple slide mounts from being lifted from the slide mount stack 100 at the same time and also is electro-mechanically coupled to a stepper motor (FIG. 8). Due to the soft texture of the cardboard slide mounts and the natural vacuum that can exist between adjacent slides, it is likely that simply lifting slide mounts from slide mount stack 100 with vacuum cups 160 will pull more than one slide mount from the top of the slide mount stack. Pulling off multiple slide mounts from the slide mount stack can jam the slide mounter 49 disrupting the slide mounting operation.

Figure 4:
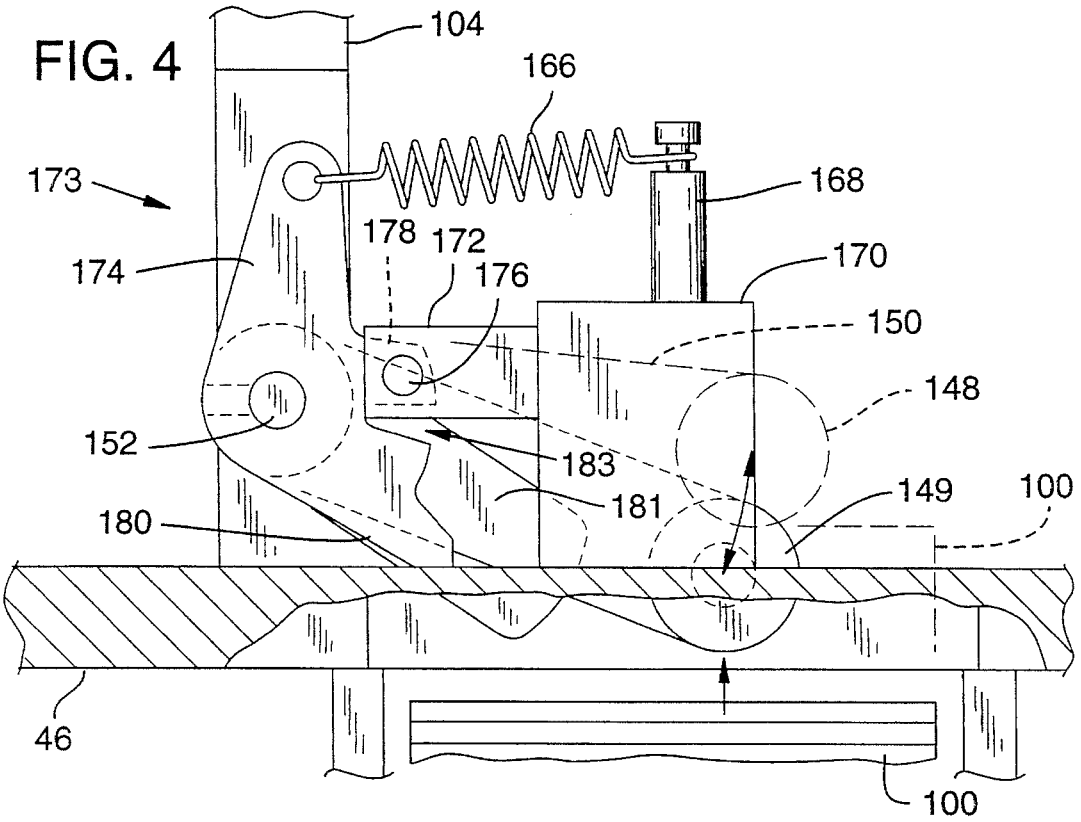
FIG. 4 is a back view of the hold-down assembly shown in FIG. 2.

FIG. 4 is a back view of the hold down assembly 102 shown in FIG. 2. The hold-down assembly includes hold-down arm 150 coupled to the front end of rod 152 and an actuating assembly 173 coupled to the back end of rod 152. The actuating assembly 173 includes an actuation arm 174 and a sensor 170. The actuating arm 174 is pivotally coupled by rod 152 to the back end of support plate 38 and is coupled to a post 168 on top of sensor 170 by a spring 166. A slotted member 172 extends horizontally toward activation arm 174 and has a sensor element 176 at the end. Activation arm 174 has an upper lip 178 positioned in member 172 and has a lower lip 180 that is separated by a notch 183. A second hold-down arm 181 is attached inside the back leg of support plate 104.

The spring 166 pulls arm 174 toward sensor 170 forcing lower lip 180 to rest in a natural position against the top of translucent floor 161. The tension of spring 167 pulls arm 174 forward forcing hold-down arm 150 into lower position 149 and causing lower lip 180 to rest on top of table 46. In the lower position 149, upper lip 178 rests inside the sensor element 176 indicating a low stack 100 level. The sensor unit 170 sends a signal to the stepper motor (FIG. 10) causing the slide mount stack 100 to move upward in small intervals forcing hold-down arm 150 upwards rotating rod 152 and corresponding arm 174 counter-clockwise. The counter-clockwise rotation raises arm 174 extending spring 166. The stepper motor continues to raise stack 100 until hold down arm 150 reaches wheel 148 whereby notch 183 between upper lip 178 and lower lip 180 trips sensor 176. Sensor unit 170 then removes the activation signal from the stepper motor and the stack 100 stops moving vertically upward.

After the top slide mount is removed from stack 100, hold-down arm 150 moves back into position 149 rotating rod 152 and actuation arm 174 clockwise. Upper lip 178 then falls back into sensor 176 thereby causing the sensor unit 170 to resend an activation signal to the stepper motor. The stepper motor then again moves the stack upward as previously described until sensor 176 is reactivated. The hold-down arm 181 keeps the top frames from the slide mount stack from inadvertently flipping over onto the associated bottom frames.

Figure 5:
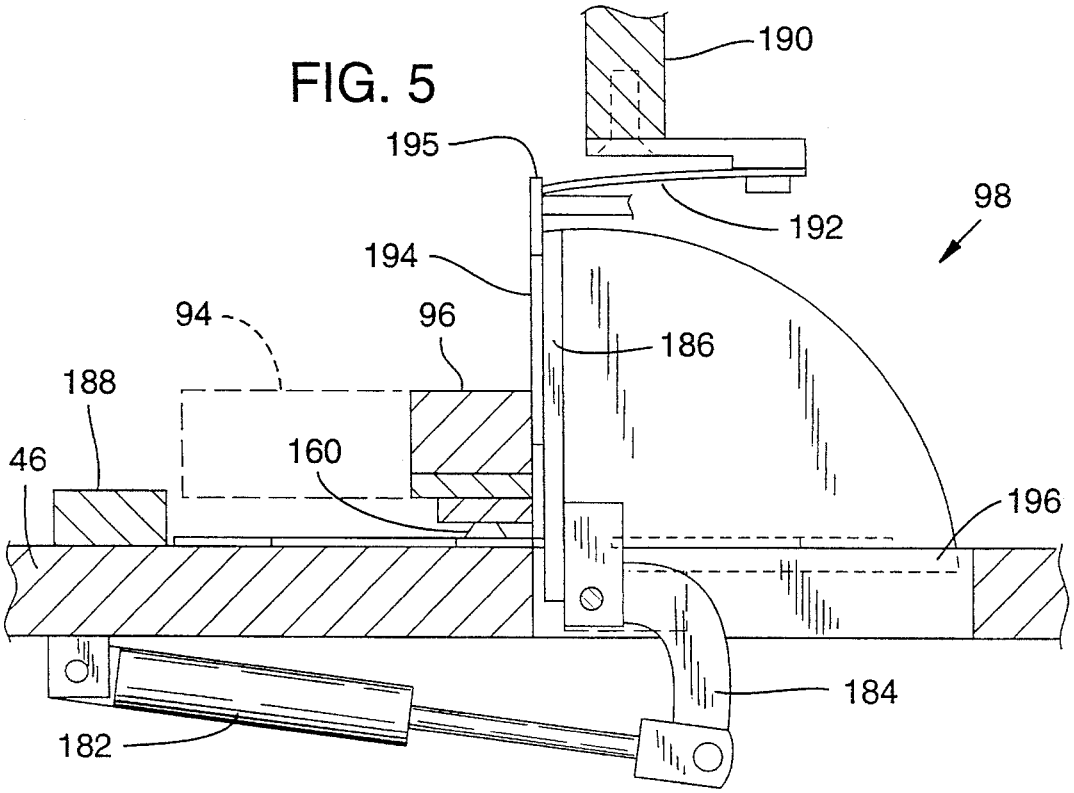
FIG. 5 is a cross-sectional side view of the in-feed station shown in FIG. 1.

FIG. 5 is a cross-sectional side view of the in-feed station 98 shown in FIG. 1. A piston 182 is attached at a first end under table 46 and is coupled at a second end to a hinge 184. The hinge 184 pivotally couples the second end of piston 182 to a platform 186. A support member 190 is coupled at the top to mounting plate 80 (FIG. 2) and is coupled at the bottom to a leaf spring 192. A slide mount 194 is shown in a 90° semi-folded position with the upper frame interposed between vacuum plate 96 and platform 186. Vacuum cups 160 are shown pressed against the bottom frame of slide mount 194. A guide rail 188 is positioned at the front of the in-feed station and is coupled to the top of table 46.

Initially, piston 182 is contracted thereby moving the platform 186 into a horizontal receiving position 196 flush with table 46. After the pick-off assembly 124 removes the top slide mount (e.g., slide mount 194) from the slide mount stack (see FIG. 3), the slide mount 194 is moved over platform 196 into in-feed station 98. The slide mount 186 after being picked up from the slide mount stack is in a substantially flat condition with both top and bottom frames positioned horizontally when carried into the in-feed station 98. Guide rail 188 keeps the slide mount aligned in the in-feed station. Vacuum plate 96 is then lowered against the top of table 46 pressing the bottom frame of slide mount 194 against the top of table 46.

Slide mount 194 is then semi-folded into the 90 degree position shown in FIG. 5 by activating piston 182. Piston 182 upon activation, extends out pushing hinge 184 and thereby pivoting platform 186 into vertical position 186. As platform 186 rotates upward, the top frame of slide mount 194 is folded upward along the same rotational axis as the platform 186. The top edge 195 of the slide mount is forced underneath leaf spring 192 moving spring 192 slightly upward. As the top frame rotates further upward, the top edge 195 moves past leaf spring 192 into the vertical position shown in FIG. 5. Leaf spring 192 then moves downward back into a non-compressed position behind the top frame of slide mount 194 keeping the top frame vertically aligned after platform 186 is rotated back into receiving position 196. Vacuum plate 96 in addition to moving slide mounts, serves the secondary function of anchoring the bottom frame against table 46 when the top frame is being folded. Vacuum plate 96 also provides an alignment wall that keeps the top frame straight when being slid underneath leaf spring 192. After slide mount 194 has been folded 90 degrees, platform 186 returns to the receiving position 196 and the vacuum cups 160 are deactivated releasing vacuum plate 96 from the bottom frame. Vacuum plate 96 is then raised and moved back over the slide mount stack. Vacuum plate 94 picks up slide mount 194 and moves it into the slide mount station 60 (FIG. 2).

Figure 6A:
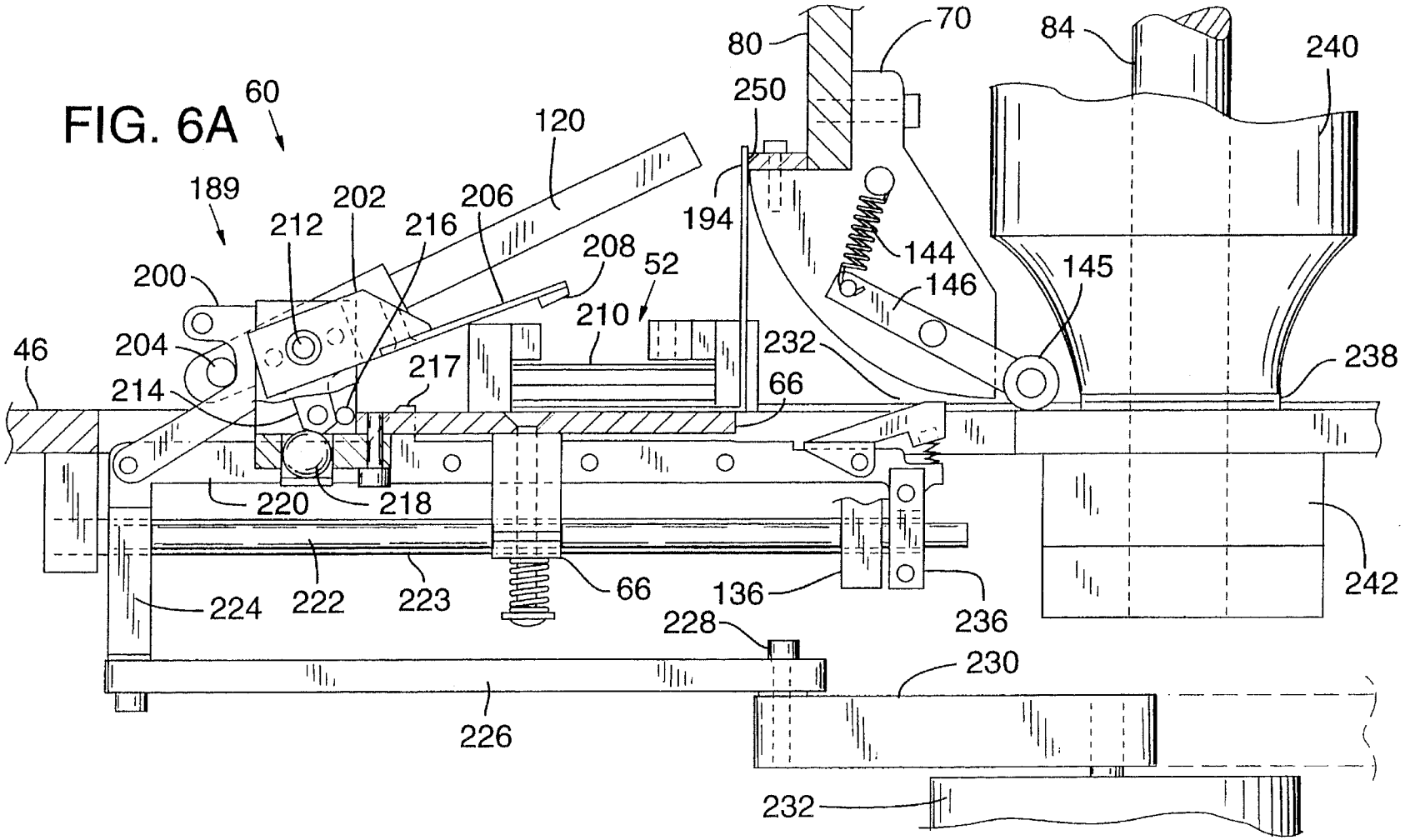
FIGS. 6A–6C are cross-sectional side views of the slide mount station shown in FIG. 2.
Figure 6B:
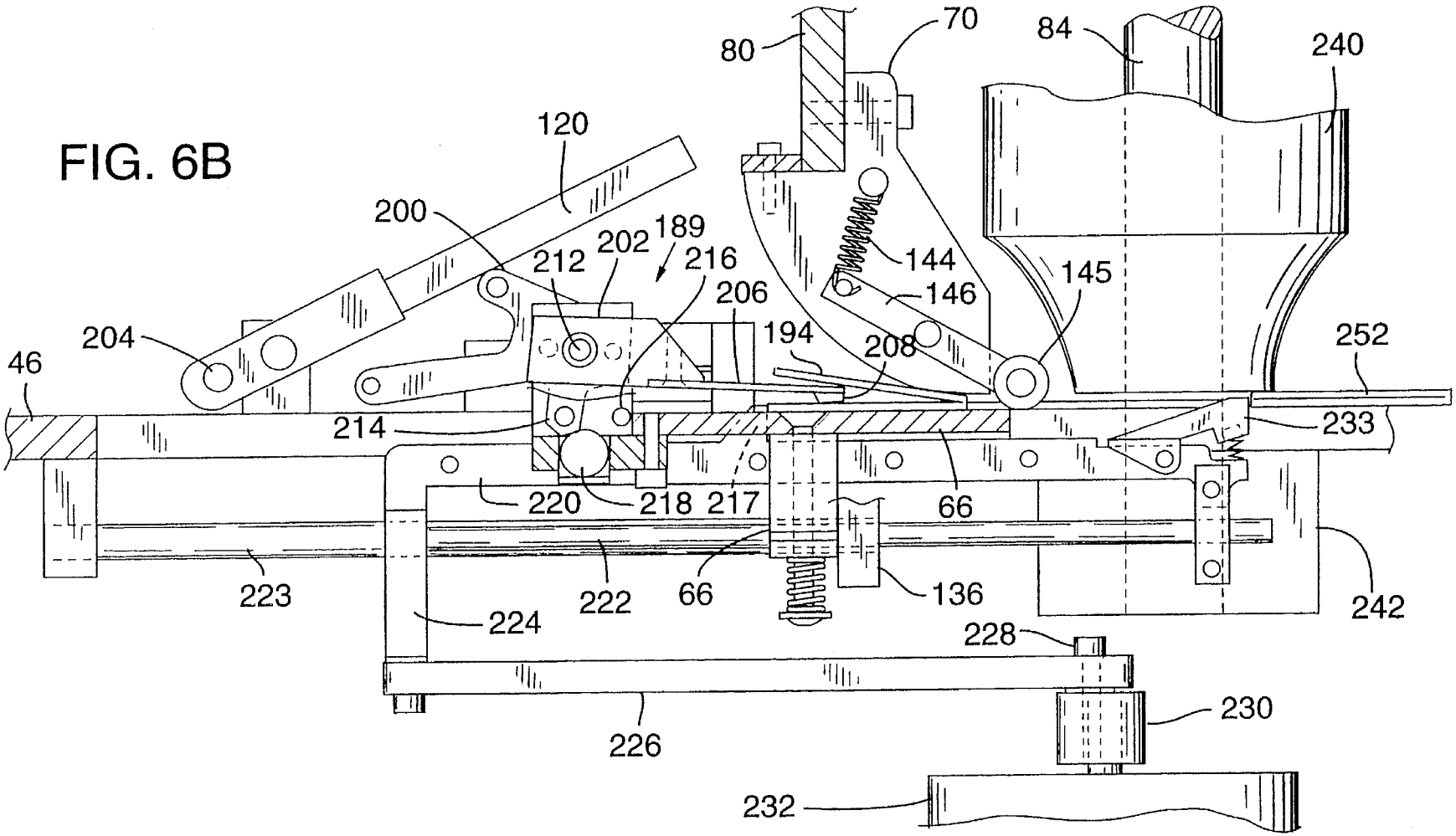
Figure 6C:
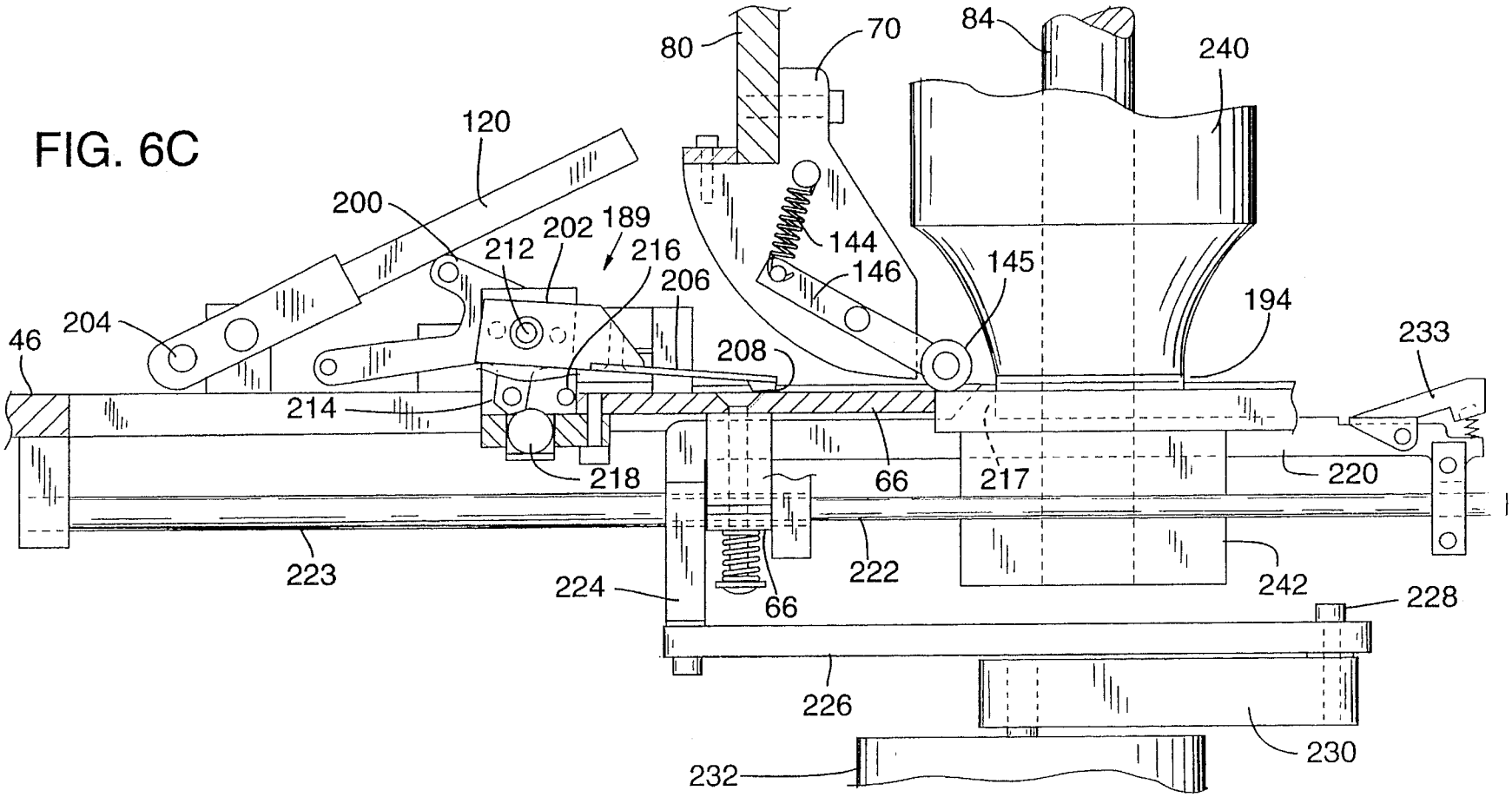

FIGS. 6A–6C are cross-sectional side views of the slide mount station 60 shown in FIG. 2. The cutter arm assembly 189 comprises the knife 22 (FIG. 2) with a rear runner 204 that rides along the back rail of knife pivot arm 200. A finger clamp 202 is pivotally coupled by a pin 212 to the knife pivot arm 200. A finger 206 is coupled at a first end of finger clamp 202 and holds a pad 208 on a second end. A lower leg 214 of the pivot arm 200 rides on a cam 218 and against a stop 216. A carriage push bar 220 is coupled at the front to a pull bar 224 and is coupled at the back to a clamp 236. Both pull bar 224 and clamp 236 are coupled to a slide rod 222. A pivot arm 226 couples the lower end of pull bar 224 to a rotating link 230. The rotating link 230 is clamped to the drive shaft of a motor 232. The carriage push bar 220 extends partially out of the top of the table 46 providing a set of teeth 217. A carriage pusher barb 233 is coupled to the back end of the carriage push bar 220. The carriage 66 (see FIG. 2) is coupled to slide rod 222 by a spring mounted clamp 66 and pull bar 224 is coupled to the front end of slide rod 222. Pull bar 224 also slides along a set of support rods 223. The bottom floor of film feed channel 52 resides adjacent to and above carriage 66. The top of compression rollers 70 are mounted to the back of plate 80 and contain a slide mount positioning plate 250. A hold down arm 146 is held up on the top end by a spring 144 and is coupled to a roller 145 at the bottom end. An ultrasonic welding head 240 is shown in a down position pressing a folded slide mount 238 against the top of table 46. An anvil 242 is coupled to the bottom of table 46 directly under the welding head 240. The welding head is supported vertically above table 46 by a set of support poles 84 (see FIG. 10).

The slide mount 194 is positioned on carriage 66 by vacuum plate 94 as previously described in FIGS. 3 and 5. A motor 232 begins rotating carriage push bar 220 is pulled forward removing the back rail of knife pivot arm 200 from under runner 204. Knife 120 pivots downward passing along the front face of film feed channel 52. The film feed channel floor 210 serves as a lower blade that in conjunction with knife 120 slices the film strip. As carriage push bar 220 is pulled forward, pin 212 moves in a clockwise rotation rotating finger clamp 202 downward and moving finger 206 downward. Knife 120 has already cut a slide from the film strip so that when finger 206 is rotated downward finger pad 208 presses the newly sliced slide against the bottom frame of slide mount 194. Finger pad 208 keeps the slide aligned in the cavity 46 previously shown in FIG. 1A. The positioning plate 250 keeps the top frame of slide mount 194 aligned vertically in the slide mount station 60.

FIG. 6B shows the carriage push bar in an intermediate position with slide mount 194 partially folded underneath the compression rollers 70. A motor 232 continues to rotate, link 230 pulls pivot arm 226 forward moving the carriage push bar 220 further forward. As the compression rollers 70 begin to press the top and bottom frames of the slide mount together, spring clamp 66 contacts stop 136 preventing the carriage 66 and the knife assembly 189 from further forward movement. The carriage push bar 220, however, continues forward causing the push bar teeth 217 to continue pushing slide mount 194 under compression rollers 70. As teeth 217 continue to move forward, slide mount 194 is pushed under roller 145 further pressing the top and bottom frames of the slide mount together. Ultrasonic head 240 moves pneumatically controlled in a vertical direction (see FIG. 6B). After sealing slide mount 252, welding assembly is raised slightly allowing slide mount 194 to be slide underneath ultrasonic head 240. The slide mount 194 then continues under ultrasonic head 240 displacing a second slide mount 252 that has previously been sealed. As carriage push bar 220 is moved further forward, pusher barb 233 pushes slide mount 252 out from under ultrasonic head 240.

FIG. 6C shows carriage push bar 220 in a fully extended forward position. Motor 232 rotates link 230 180 degrees from its initial position shown in FIG. 6A pulling pull bar 224 against spring clamp 66. Teeth 217 move the slide mount 194 underneath ultrasonic head 240 and pusher barb 233 completes moving slide mount 238 (FIG. 6B) away from the welding assembly. Ultrasonic head 240 is then further lowered down onto slide mount 194 sealing the upper and lower frames together. Motor 232 then begins the second half of rotation moving carriage push bar 220 back into the position shown in FIG. 6A. As push bar 220 is moved back into its original position, knife pushed up and reseated into knife pivot arm 200. As knife pivot arm 200 is rotated counter-clockwise, lower leg 214 is moved against stop 216 forcing up finger clamp 202 and finger 206. The carriage 66 is moved back into a slide and slide mount receiving position as previously shown in FIG. 6A. The next slide mount is then moved into the slide mount station and the next slide on the film slide slice from positioned in the film strip 36 (FIG. 2).

Figure 7:
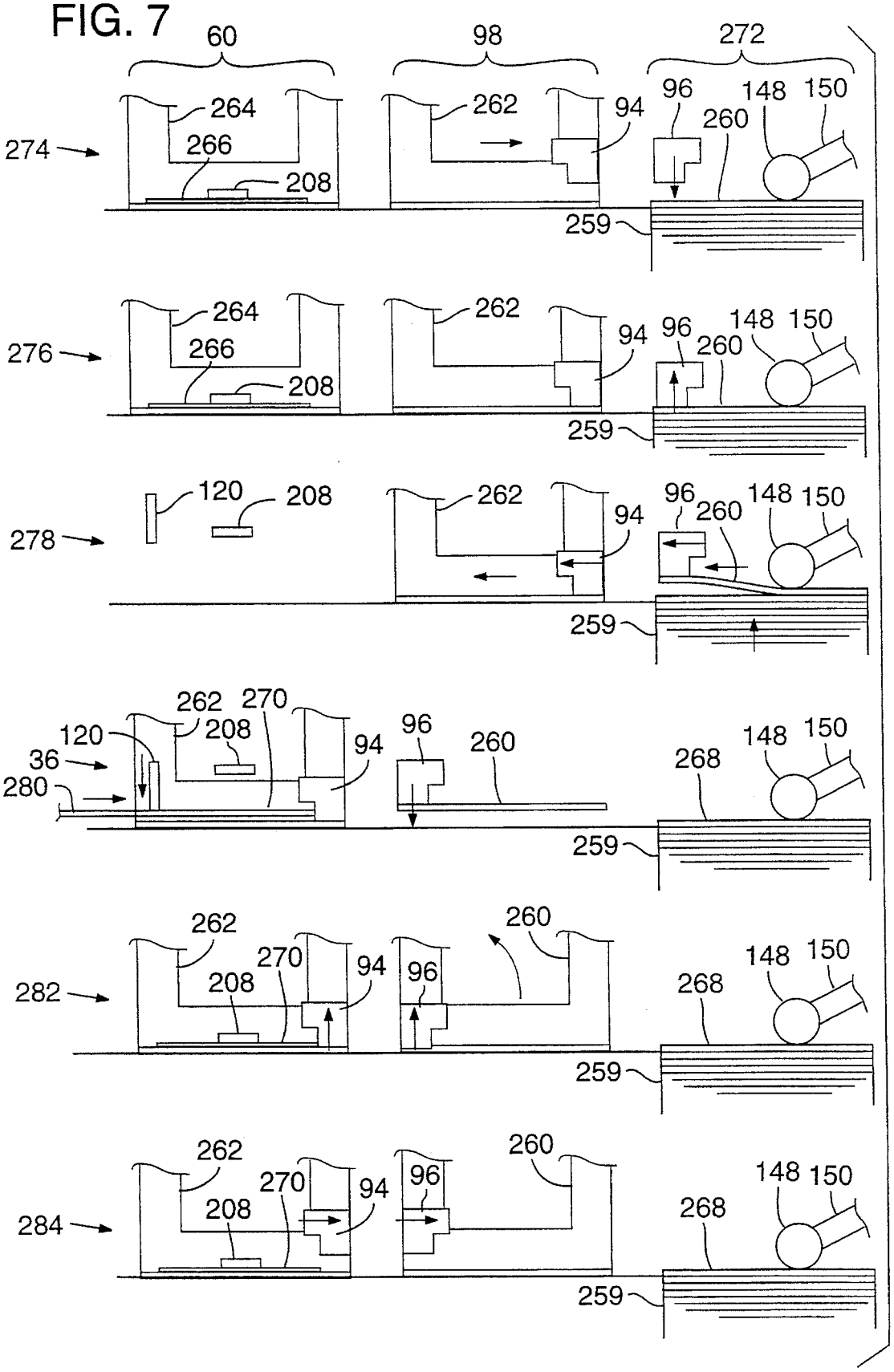
FIG. 7 is a set of diagrams showing the operation of the pick-off mechanism shown in FIG. 2.

FIG. 7 is a schematic showing the pick-off and mounting operations described above. During normal operation hold-down arm 150 and wheel 148 rest on the top of slide mount stack 259 in a pick-off station 272. From a previous pick-off process step 274 a slide mount 262 is folded in a 90 degree configuration in in-feed station 274, and a film slide 266 is loaded into a third slide mount 264. Vacuum plate 96 is positioned over slide mount stack 259 and vacuum plate 94 is positioned over in-feed station 98. A finger pad 208 (see FIG. 6A) is pressing against the top of a film strip 266 in slide mount station 60. In process step 276 vacuum plate 96 is lowered onto slide mount 260 and vacuum plate 94 is lowered onto slide mount 262. Slide mount 264 is moved under the compression rollers 70 as previously shown in FIG. 6B. In process step 278 vacuum plate 96 lifts a first end of slide mount 260 while hold-down wheel 148 temporarily holds down a second end of slide mount 260 ensuring that a single slide mount is lifted off stack 259. Vacuum plate 94 moves slide mount 262 over mounting station 60. During process step 278 the slide mount 264 previously residing in mounting station 60 is moved under ultrasonic welding head 240 and the finger pad 208 and knife 120 are raised into a receiving position (see FIGS. 6A–6C).

In process step 280 vacuum plate 96 lifts slide mount 260 out from under hold-down wheel 148 and over in-feed station 98. After slide mount 260 is removed from slide mount stack 259, hold-down arm 150 moves slightly downward. The activation system previously shown in FIG. 4 then directs the stepper motor (FIG. 8) to move the slide mount stack 259 upward until the top slide mount 268 reaches the same elevation as previously obtained by slide mount 260. Slide mount 262 is then moved into mounting station 60 by vacuum plate 94. The film strip 36 is fed into mounting station 60 and knife 120 moved downward cutting off slide 270. In process step 282 vacuum plate 96 moves slide mount 260 into in-feed station 98. Platform 186 (FIG. 5) folds the top half of slide mount 260 up 90 degrees against vacuum plate 96. Finger pad 208 is lowered down on top of film slide 270 and the slide mount 262 carried underneath the compression rollers 70 (FIG. 6A). In process step 284 vacuum plates 94 and 96 are raised and moved back into their initial positions shown in process step 274.

Thus, a process has been shown with steps 274–284 that effectively picks off slide mounts from a slide mount stack, inserts a film slide in the slide mount, and folds the top and bottom halves of the slide mount over the film slide. The pneumatically controlled movements of the slide mounts with vacuum plates 94 and 96 reduce the common slide mount jamming and misfeeds that occur in other mounting apparatus. The novel pick-off and hold-down apparatus prevent multiple slide mounts from jamming the mounting equipment.

FIG. 8 is a front view of a slide mount hopper 308 previously shown in part in FIG. 3. The hopper comprises a frame 290 that contains a carousel 156 and motorized stack lifting apparatus 310. The carousel 156 includes a first hopper 164 shown in position ready for pick-off operations and a second hopper 166 shown in a reserve position. The carousel 156 is coupled to a rotatable shaft 312. The top of shaft 312 is coupled to rod 128 and the bottom of shaft 312 is coupled thought the floor of frame 290 to rotational damping apparatus 302. The top of rod 128 is coupled to handle 106 previously shown in FIG. 2. Both hopper 166 and hopper 164 receive a rack 114. The lifting apparatus 310 comprises a screw rod 158 coupled at the top end to the bottom of table 46 and coupled at the lower end through the floor of frame 290 to a stepper motor 300. A set of guide rods 332 are coupled between table 46 and the floor of frame 290. An elevator 298 has internal teeth that engage screw rod 158. A lift arm 294 is coupled by a brace 296 to the elevator 292. A top actuator switch 306 and a bottom actuator switch 304 are coupled to the side wall of frame 290.

Figure 9:
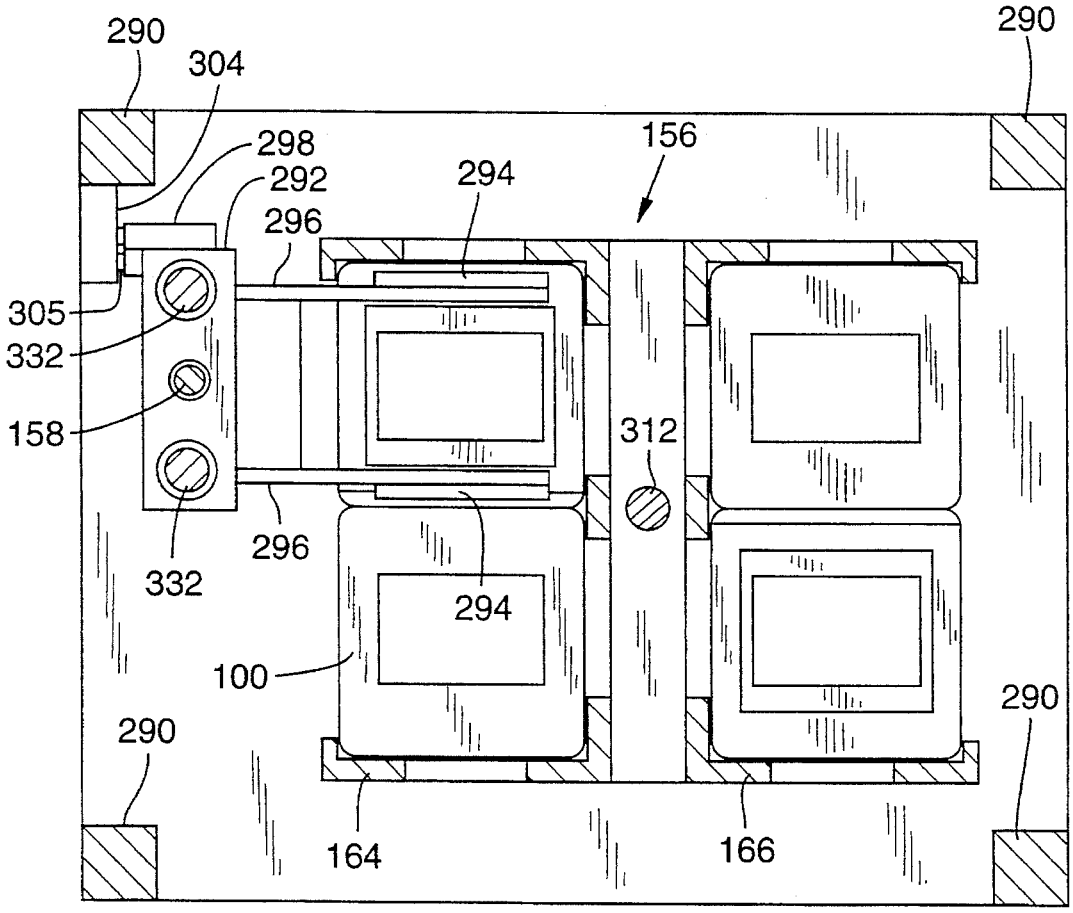
FIG. 9 is a bottom view of the slide mount hopper shown in FIG. 8.

FIG. 9 is a bottom view of the slide mount hopper 308. The lower actuator 304 has a set of switches 305 that are depressed by a slide 298 on elevator 292. The screw rod 158 extends through the center of elevator 292 and a pair of guide rods 332 extend through the sides of elevator 292. The brace 296 support the lift arms 294 underneath the slide mount stack 100.

The elevator 292 is initially in a lowered position 312. In the lowered position carousel 156 is free to rotate clockwise or counter clockwise 180 degrees. Elevator 292, in the lowered position, activates the actuator switch 304 preventing operation of the slide mounting equipment and allowing carousel 156 to move either hopper 164 or hopper 166 into a pick-off position. Whichever hopper is not going to be used during the next mounting process can be loaded with a new rack of slide mounts. After the hoppers have been loaded, an operator directs motor 300 through control panel 48 to begin rotating screw rod 158. Screw rod 158 raises elevator 292 until slide mount stack 100 raises the hold-down arm 150 into a "pick-off ready" position as previously shown in FIG. 4. Stepper motor 300 is then deactivated and the slide mounter 45 is ready to begin normal mounting operations.

As a slide mount is removed from the slide mount stack 100, stepper motor 300 is activated until the top slide mount moves hold-down arm 150 back into the "pick-off ready" position. Elevator 292 continues to move incrementally upward toward table 46 each time a slide mount if remove from slide mount stack 100. When elevator 292 almost reaches table 46 actuator switch 306 disables the slide mounting system and indicates that hopper 164 is empty. Stepper motor 300 is reversed and elevator 292 lowered until it trips actuator 304. In the lowered position 312 carousel 156 is again free to rotate so that hopper 166 and hopper 164 can exchange positions. It is important to note that the reserve hopper can be loaded while the system is running. This reduces downtime after a hopper has been emptied since reloading the system simply requires rotating the carousel 180 degrees. Damping apparatus 302 provides easy rotation of carousel 156 with handel 106 (FIG. 2) and holds the hoppers securely in one of the two positions shown in FIG. 8.

Figure 10:
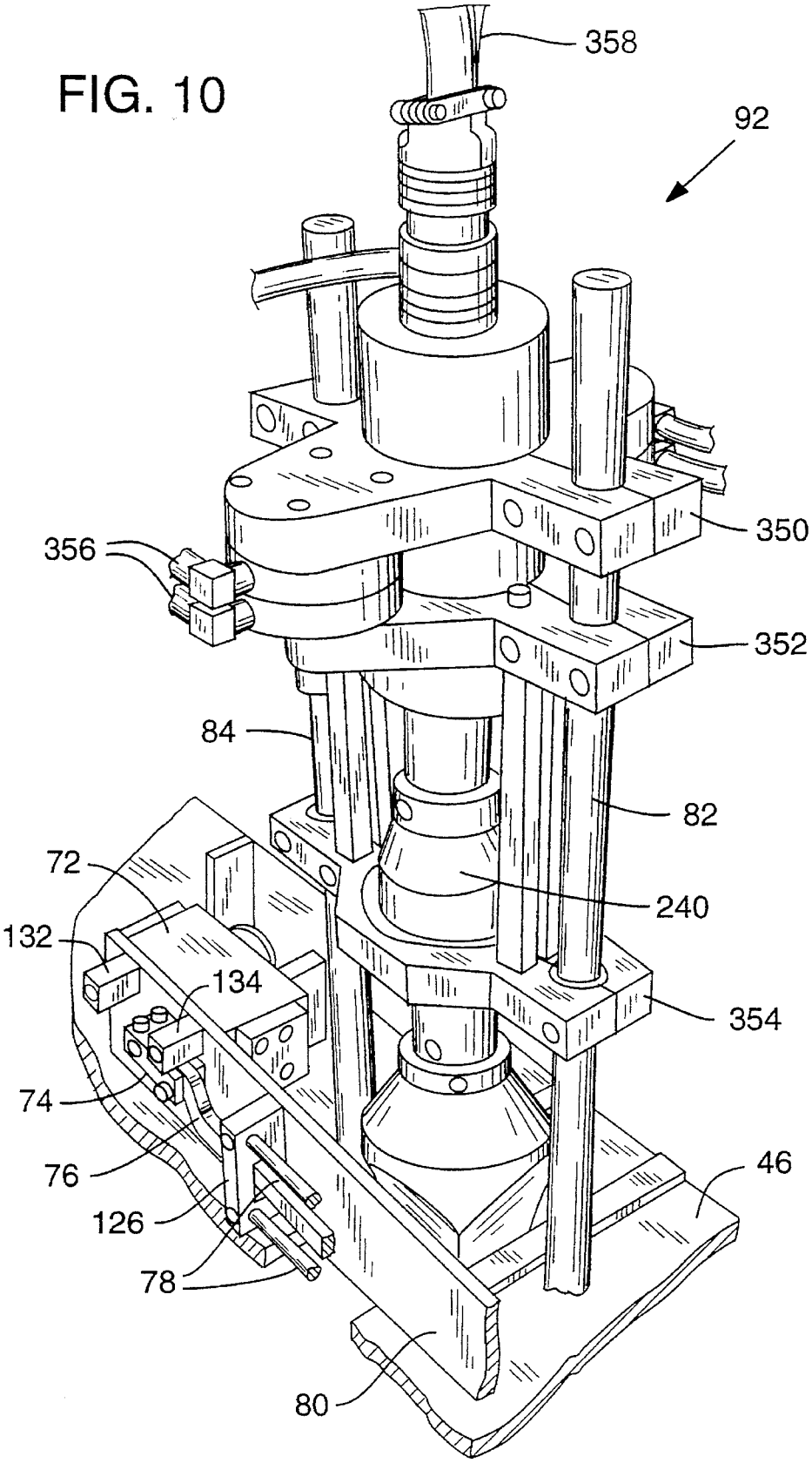
FIG. 10 is a front perspective view of the ultrasonic welding head shown in FIG. 2.
Figure 11:
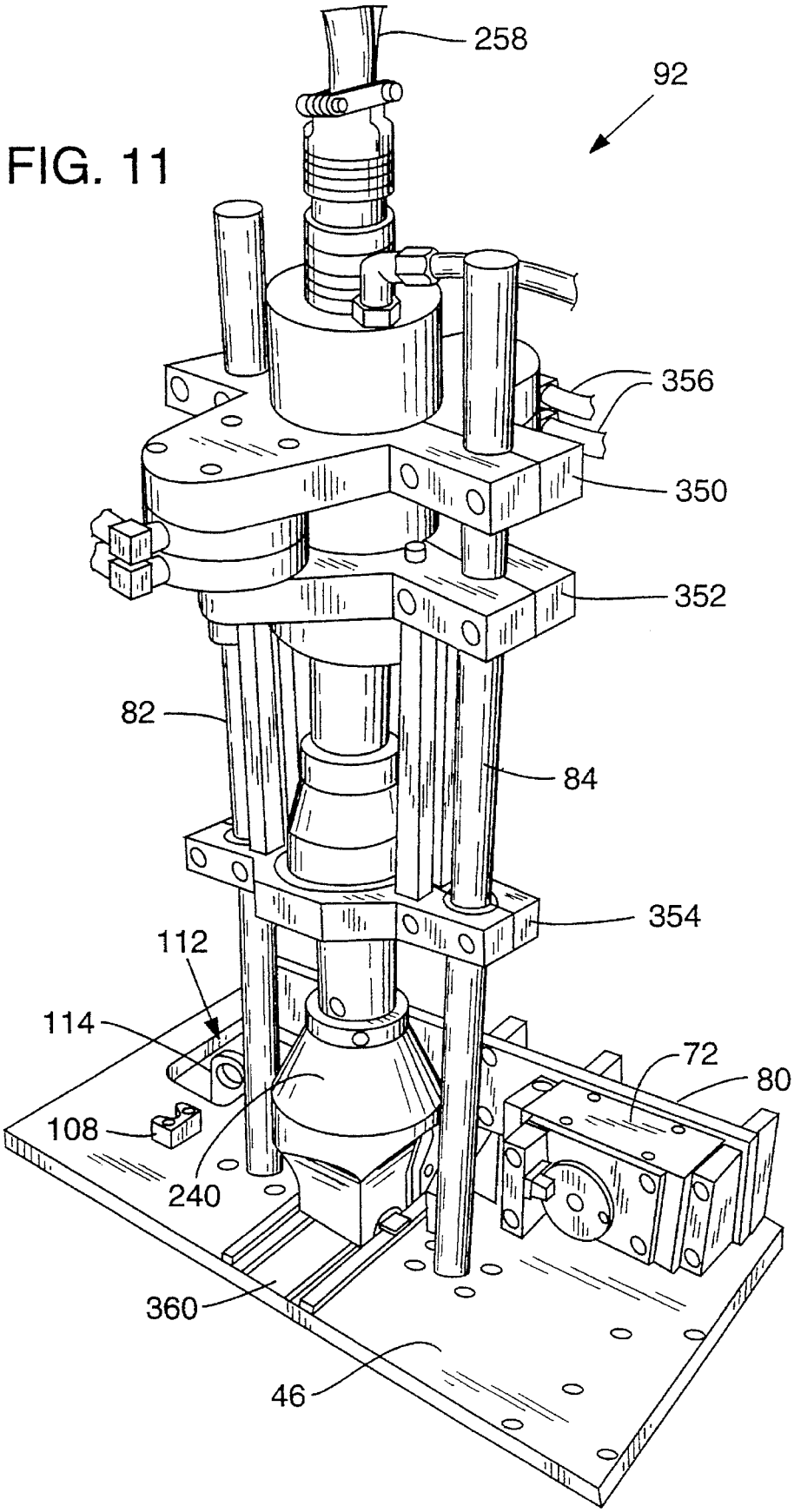
FIG. 11 is a rear perspective view of the ultrasonic welding head shown in FIG. 2.

FIG. 10 is a front perspective of the welding assembly 92. The welding assembly includes a pair of support rods 82 and 84 that hold various support plates 350, 352, and 354. The support plates hold the ultrasonic welding head 240 vertically above the table 46. Various pneumatic hoses 356 control vertical positioning of the ultrasonic welding head 240. A power cable 358 is coupled to the top of the ultrasonic assembly 92. Ultrasonic equipment is well known to those skilled in the art and is therefore not described in detail. FIG. 11 is a rear perspective view of the ultrasonic welding assembly 92 previously shown in FIG. 10. The motor 72 is coupled to the back of support plate 80. The mounting rail 360 begins at the end of the film feed channel 52 (FIG. 2) and extends past the back of ultrasonic welding head 240 to the end of table 46. Mounting rail 360 can optionally feed a slide printer (not shown) or can feed into a slide receiving track (not shown).

The ultrasonic welding head vibrates the top half of the slide mount creating a friction between the internal faces of the top and bottom halves of the slide mount. This friction heats the adhesive previously inserted inside the slide mount melting the heat sensitive adhesive and sealing the top and bottom halves of the slide mount together. The ultrasonic welding head allows slide mounts to be sealed without using a high temperature heat source. This vibration technique reduces the possibility that photographic slides will be destroyed in the event that the slide mount becomes jammed during the sealing process.

As previously described in FIG. 1A, a spacer 22 is attached to the inside of the slide mount. The upper half of the slide mount is then vibrated by ultrasonic welding head 240 causing the top half of the slide mount to rub against the spacer 22. The frictional heat between the upper half of the slide mount and the spacer melt the adhesive on spacer 22 sealing the top and bottom halves of the slide mount together. In addition, the slide inside cavity 46 is not effected by the ultrasonic vibration regardless on how long the slide mount remains under the activated welding head 240. Therefore, the sealing process will not damage the film slides even if a slide mount becomes jammed underneath the welding apparatus 92.

Having described and illustrated the principles of the invention in a preferred embodiment thereof, it should be apparent that the invention can be modified in arrangement and detail without departing from such principles. We claim all modifications and variation coming within the spirit and scope of the following claims.

We claim:

1. A system for mounting photographic film frames, comprising:

film mounting apparatus for receiving a reel of film and inserting the photographic film frames from the reel into slide mounts;

a slide mount hopper including a motorized stack lifting apparatus for holding and moving a stack of slide mounts up and down along a vertical axis; and pick-off apparatus for removing the slide mounts from the top of the stack and placing them into the film mounting apparatus, the motorized stack lifting apparatus moving the stack upwards a distance substantially equal the thickness of a single slide mount each time a photo mount is removed from said stack with the pick-off mechanism.

2. A system for mounting photographic film frames, comprising:

film mounting apparatus for receiving a reel of film and inserting the photographic film frames from the reel into slide mounts;

a slide mount hopper for holding and moving a stack of slide mounts up and down along a vertical axis;

pick-off apparatus for removing the slide mounts from the top of the stack and placing them into the film mounting apparatus, the hopper moving the stack upwards a distance substantially equal the thickness of a single slide mount each time a photo mount is removed from said stack with the pick-off mechanism and;

a hold-down device residing on top of the slide mount stack and electro-mechanically coupled to the hopper for both indicating when a slide mount has been removed from the stack and preventing more than one slide mount from being lifted off the stack at a time.

3. The system according to claim 2 wherein the hold-down device comprises an arm pivotally coupled to the film mounting apparatus, the arm temporarily holding down a first end of the top slide mount on the slide mount stack as a second end of the top slide mount is being lifted by the pick-off mechanism.

4. A system for mounting photographic film frames, comprising:

film mounting apparatus for receiving a reel of film and inserting each photographic film frame from the reel into a slide mount;

a slide mount hopper for holding and moving a stack of slide mounts up and down along a vertical axis;

the hopper including a carousel for holding multiple stacks of slide mounts, the carousel capable of moving each stack into the same position used by the pick-off mechanism for removing the slide mounts; and pick-off apparatus for removing the slide mounts from the top of the stack and placing them into the film mounting apparatus, the hopper moving the stack upwards a distance substantially equal the thickness of a single slide moving each time a photo mount is removed from said stack with the pick-off mechanism.

5. A system for mounting photographic film frames, comprising:

film mounting apparatus for receiving a reel of film and inserting the photograph film frames from the reel into slide mounts;

a slide mount hopper for holding and moving a stack of slide mounts up and down along a vertical axis;

pick-off apparatus for removing the slide mounts from the top of the stack and placing them into the film mounting apparatus, the hopper moving the stack upwards a distance substantially equal the thickness of a single slide mount each time a photo mount is removed from said stack with the pick-off mechanism; and racks insertable into the hopper for retaining and keeping the stack of slide mounts aligned in substantially the same direction.

6. A system for mounting photographic film frames, comprising:

film mounting apparatus for receiving a reel of film and inserting each photographic film frame from the reel into a slide mount;

a slide mount hopper for holding and moving a stack of slide mounts up and down along a vertical axis;

pick-off apparatus for removing the slide mounts from the top of the stack and placing them into the film mounting apparatus, the hopper moving the stack upwards a distance substantially equal the thickness of a single slide mount each time a photo mount is removed from said stack with the pick-off mechanism; and a table for holding the film feed, hopper and pick-off mechanism, the hopper extending below the table and feeding slide mounts up through the top of the table to the pick-off mechanism.

7. A system for mounting photographic film frames, comprising:

film mounting apparatus for receiving a reel of film and inserting each photographic film frame from the reel into a slide mount;

a slide mount hopper for holding and moving a stack of slide mounts up and down along a vertical axis; and pick-off apparatus for removing the slide mounts from the top of the stack and placing them into the film mounting apparatus, the hopper moving the stack upwards a distance substantially equal the thickness of a single slide mount each time a photo mount is removed from said stack with the pick-off mechanism;

the pick-off apparatus including first and second pneumatically controlled arms having separately controlled vacuum elements for lifting and placing the slide mounts into the mounting apparatus.

8. A system for mounting photographic film frames, comprising:

film mounting apparatus for receiving a reel of film and inserting each photograph from the reel into a slide mount;

a slide mount hopper for holding and moving a stack of slide mounts up and down along a vertical axis;

pick-off apparatus for removing the slide mounts from the top of the stack and placing them into the film mounting apparatus, the hopper moving the stack upwards a distance substantially equal the thickness of a single slide mount each time a photo mount is removed from said stack with the pick-off mechanism; and an ultrasonic welding head for receiving the slide mounts from the film mounting apparatus and welding the slide mounts into the inserted photographs.

9. A slide mounter, comprising:

a table having a feed for moving a reel of film through a film feed channel;

a hopper attached below the table for holding a stack of slide mounts;

slide mounting apparatus for inserting and sealing individual film frames inside the slide mounts; and a pick-off mechanism for removing the slide mounts from the top of the slide mount stack and placing them into the film feed channel, the stack of slide mounts moved upward each time one of said slide mounts is removed from the top of the slide mount stack.

10. The slide mounter according to claim 9 wherein the hopper includes a carousel for holding a first and a second stack of slide mounts, each stack rotatable into a predetermined position underneath the pick-off station.

11. The slide mounter according to claim 9 wherein the slide mounter includes an in-feed station for bending each slide mount into an initial holding position for receiving an associated film frame.

12. The slide mounter according to claim 9 wherein the slide mounting apparatus includes a knife for slicing the reel of film into individual frames and a paddle for holding the films in the slide mounts.

13. The slide mounter according to claim 11 including compression rollers for folding the slide mount over the inserted frame.

14. The slide mounter according to claim 11 wherein the pick-off apparatus lift a first slide mount from the stack into the in-feed station and move a second slide mount into the mounting apparatus at the same time.

15. The slide mounter according to claim 9 including a printer coupled to the table for printing information onto the slide mounts.

16. A method for mounting film into slide mounts, comprising:

separating film from a reel into individual film frames;

holding at least one stack of slide mounts upward in a vertical direction;

picking off the slide mounts from the top of the stack at a given pick-off location;

moving the stack in response to an electro-mechanical signal, the electro-mechanical signal indicating removal of a slide mount from the stack; and sealing each individual photograph inside one of the slide mounts taken from the slide mount stack.

17. A method for mounting slides into slide mounts, comprising:

separating photographs from a reel into individual photographs;

holding at least one stack of slide mounts upward in a vertical direction;

picking off the slide mounts from the top of the stack at a given pick-off location by picking off the slide mounts holding down one end of the top slide on the slide mount stack and lifting up on the opposite end of said slide mount; and sealing each individual photograph inside one of the slide mounts taken from the slide mount stack.

18. A method according to claim 16 including keeping the top of the slide mount stack at a constant level and pressure by lifting the slide mount stack upwards each time a slide mount is picked off.

19. The method for mounting slides into slide mounts, comprising:

separating photographs from a reel into individual photographs:

holding at least one stack of slide mounts upward in a vertical direction;

picking off the slide mounts from the top of the stack at a given pick-off location;

sealing each individual photograph inside one of the slide mounts taken from the slide mount stack:

holding two stacks of slide mounts upward in a vertical direction; and moving each stack to the same pick-off location.

20. A method for mounting slides into slide mounts, comprising:

separating photographs from a reel into individual photographs;

holding at least one stack of slide mounts upward in a vertical direction;

picking off the slide mounts from the top of the stack at a given pick-off location; and sealing each individual photograph inside one of the slide mounts taken from the slide mount stack by placing adhesive on the inside of each slide mount and vibrating one side of said slide mount at a sufficient frequency to melt the adhesive and glue the slide mount together;

the step of picking off the slide mounts includes holding down one end of the top slide on the slide mount stack and lifting up on the opposite end of said slide mount.

* * * * *